US007376377B2

(12) United States Patent
Shimomura et al.

(10) Patent No.: US 7,376,377 B2
(45) Date of Patent: May 20, 2008

(54) CONDUCTIVE ENDLESS BELT AND IMAGE FORMING APPARATUS USING THE SAME

(75) Inventors: Toshiaki Shimomura, Kanagawa (JP); Yoshikazu Ueno, Kanagawa (JP); Hiroshi Akabane, Kanagawa (JP)

(73) Assignee: Bridgestone Corporation, Tokyo (JP)

( * ) Notice: Subject to any disclaimer, the term of this patent is extended or adjusted under 35 U.S.C. 154(b) by 132 days.

(21) Appl. No.: 11/213,715

(22) Filed: Aug. 30, 2005

(65) Prior Publication Data

US 2006/0051140 A1 Mar. 9, 2006

(30) Foreign Application Priority Data

Sep. 3, 2004 (JP) ..... 2004-257537

(51) Int. Cl.
*G03G 15/16* (2006.01)

(52) U.S. Cl. ..... 399/303; 399/302

(58) Field of Classification Search ..... 399/302, 399/303, 308, 313; 430/126, 126.1; 252/500
See application file for complete search history.

(56) References Cited

U.S. PATENT DOCUMENTS 5,715,510 A * 2/1998 Kusaba et al. ..... 399/308
6,132,828 A * 10/2000 Yasui et al. ..... 399/302 X
7,139,497 B2 * 11/2006 Takehara ..... 399/302 X
7,141,183 B2 * 11/2006 Hattori et al. ..... 252/500
2002/0021920 A1 * 2/2002 Hayakawa et al. ..... 399/303
2004/0220301 A1 * 11/2004 Hattori et al. ..... 524/155
2005/0127333 A1 * 6/2005 Onuki et al. ..... 252/500
2005/0170274 A1 * 8/2005 Matsumura et al. ..... 430/126
2005/0196202 A1 * 9/2005 Suzuki et al. ..... 399/302

FOREIGN PATENT DOCUMENTS

JP 9-227717 A 9/1997
JP 10-120924 A 5/1998
JP 2000-327922 A 11/2000
JP 2001-125396 A 5/2001
JP 2002-365866 A 12/2002

* cited by examiner

*Primary Examiner*—Sophia S. Chen
(74) *Attorney, Agent, or Firm*—Sughrue Mion, PLLC

(57) ABSTRACT

A high performance conductive endless belt and an image forming apparatus using the same are provided, the conductive endless belt having superior strength, in particular, superior folding endurance, stable and appropriate electrical resistance even in high voltage application, less voltage dependence of electrical resistance, and superior durability in image output and transfer efficiency. The conductive endless belt is formed by adding a high molecular weight ionic conductive agent and a fluorinated surfactant to a base material selected from the group consisting of (a) a thermoplastic PA, (b) an ABS resin, (c) a thermoplastic POM, (d) a polymer alloy or a polymer blend containing at least two of the above (a) to (c), and (e) a polymer alloy or a polymer blend containing a thermoplastic resin and at least one of the above (a) to (c).

14 Claims, 2 Drawing Sheets

CONDUCTIVE ENDLESS BELT AND IMAGE FORMING APPARATUS USING THE SAME

BACKGROUND OF THE INVENTION

1. Field of the Invention

The present invention relates to a conductive endless belt (hereinafter simply referred to as "belt" in some cases) and an image forming apparatus using the same, the endless belt being used when a toner image is transferred to a recording medium such as paper in an electrostatic recording process performed in an electrostatic recording apparatus or an electrophotographic apparatus such as a copy machine or a printer, the toner image being formed by supplying a developer onto the surface of an image forming member such as a latent image holding member holding a latent image thereon.

2. Description of the Related Art

Heretofore, in an electrostatic recording process performed in a copy machine, a printer, or the like, printing is performed by the steps of uniformly electrifying the surface of a photosensitive member (latent image holding member), forming an electrostatic latent image by projecting an optical image from an optical system onto this photosensitive member to diselectrify the area to which light is applied, then supplying toner to this electrostatic latent image to form a toner image by electrostatic adhesion of the toner, and transferring the toner image to a recording medium such as paper, transparent paper for overhead projector use, or photographic paper.

Also in a color printer or color copy machine, although the printing is fundamentally performed in accordance with the process described above, in the case of color printing in which four color toners, magenta, yellow, cyan, and black, are used for reproducing a color tone, a step of overlapping the color toners at a predetermined ratio is required, and in order to execute this step, various methods have been proposed.

As a first method, an image on image development method may be mentioned in which, as is the case of monochromatic printing, in order to form an electrostatic latent image into a visible color toner image, the above four color toners, magenta, yellow, cyan, and black, are sequentially supplied onto a photosensitive member so as to be superimposed for development. By the method described above, a relatively compact apparatus can be formed; however, it is very difficult to control the gradation, and as a result, a problem may arise in that a high quality image is not obtained.

As a second method, a tandem method using four photosensitive drums may be mentioned in which after latent images on the drums are developed by respective color toners, magenta, yellow, cyan, and black to form four toner images of magenta, yellow, cyan, and black, the photosensitive drums provided with the above respective toner images thereon are aligned, and the toner images thereof are then sequentially transferred to a recording medium such as paper for superimposing the images thereon, thereby reproducing a color image. By this method, superior image can be obtained; however, since the four drums each provided with an electrification mechanism and a development mechanism are aligned, the apparatus becomes large and expensive.

In FIG. 2, one example of a printing portion of a tandem image forming apparatus is shown. Four printing units each composed of a photosensitive drum 1, an electrification roller 2, a developing roller 3, a developing blade 4, a toner supply roller 5, and a cleaning blade 6 are provided for respective yellow Y, magenta M, cyan C, and black B toners, and the toners are sequentially transferred onto paper transported by a transfer/transport belt 10 which is circularly driven by a drive roller (drive member) 9, thereby forming a color image. Electrification and diselectrification of the transfer/transport belt 10 are performed by an electrification roller 7 and a diselectrification roller 8, respectively. In addition, for electrification of paper to adsorb it on the belt, an adsorption roller (not shown) is used. By the structure described above, the generation of ozone can be suppressed. The adsorption roller transfers paper from a transport path onto the transfer/transport belt 10 and also fixes it thereon by static adsorption. In addition, after the transfer, for separation of paper from the belt, an adsorption force between paper and the transfer/transport roller 10 is decreased by decreasing a transfer voltage, so that paper can be separated only by means of curvature separation.

As a material of the transfer/transport belt 10, a resistive material and a dielectric material may be used; however, each material has advantages and disadvantages. Since a resistive belt retains charges for a short period of time when being used for transfer operation of the tandem method, charge injection caused by the transfer is low, and even by continuous transfer operation of the four colors, the increase in voltage is relatively small. In addition, even when being used repeatedly for the following paper, the resistive belt releases charges, and hence electrical reset is not required. However, since the electrical resistance of the resistive belt varies with the change in environmental conditions, problems may arise in that the transfer efficiently varies, and/or the thickness and the width of paper adversely influence the transfer performance.

On the other hand, in the case of a dielectric belt, injected changes are not spontaneously released, and hence injection and release of charges must both be electrically controlled. However, since charges are stably retained, adsorption of paper is reliably performed, and hence highly precise paper transport can be performed. In addition, the dielectric constant has a small temperature and humidity dependence, and hence a relatively stable transfer process may be performed in various environments. As disadvantages, the increase in transfer voltage may be mentioned which is caused by accumulation of charges in the belt as the transfer is repeatedly performed.

As a third method, a transfer drum method may be mentioned in which after a recording medium such as paper is wound around a transfer drum, while the drum is allowed to rotate four times, magenta, yellow, cyan, and black toners provided on photosensitive members are sequentially transferred on the medium at respective rotations of the drum, thereby reproducing a color image. According to this method, a relatively high quality image can be obtained; however, when the recording medium is thick such as a postcard, it is difficult to wind the medium around the transfer drum, and hence the type of recording medium is disadvantageously limited.

In addition to the multilayer transfer method, the tandem method, and the transfer drum method described above, as a method in which a high image quality can be obtained, the size of the apparatus is not particularly increased, and the type of recording medium is not particularly limited, an intermediate transfer method has been proposed.

That is, according to this intermediate transfer method, an intermediate transfer member is provided which is composed of a belt and drums designed to temporarily retain toner images transferred from respective four photosensitive members, and four photosensitive members having a magenta toner image, a yellow toner image, a cyan toner image, and a black toner image are disposed around this intermediate transfer member. In the structure described above, the four color toner images are sequentially transferred onto the intermediate transfer member to form a color image thereon, and this color image is then transferred onto a recording medium such as paper. Accordingly, since the gradation is adjusted by superimposing the four toner images, a high image quality can be obtained, and unlike the tandem method, since the photosensitive members are not necessarily aligned, the size of the apparatus is not particularly increased. In addition, the recording medium is not required to be wound around the drum, and hence the type of recording medium is not specifically limited.

As an apparatus forming a color image in accordance with the intermediate transfer method, an image forming apparatus using an endless belt as the intermediate transfer member is shown in FIG. 3 by way of example.

In FIG. 3, reference numeral 11 indicates a drum-shaped photosensitive member which is allowed to rotate in the direction shown by an arrow in the figure. This photosensitive member 11 is electrified by a primary electrifier 12, a part of the member 11 exposed to an image exposure 13 is then diselectrified thereby, an electrostatic latent image corresponding to a first color component is subsequently formed on this photosensitive member 11, the electrostatic latent image is further developed by a developer 41 using a magenta toner M which is the first color, and as a result, the first-color magenta toner image is formed on the photosensitive member 11. Next, this toner image is then transferred onto an intermediate transfer member 20 circularly driven by a drive roller (drive member) 30 while it is being in contact with the photosensitive member 11. In this case, the transfer from the photosensitive member 11 to the intermediate transfer member 20 is performed at a nip portion formed therebetween by a primary transfer bias applied from a power source 61 to the intermediate transfer member 20. After the first-color magenta toner image is transferred onto this intermediate transfer member 20, the surface of the photosensitive member 11 is cleaned by a cleaning device 14, and hence a first development and transfer operation of the photosensitive member 11 is complete. Subsequently, while the photosensitive member 11 is allowed to rotate three times, at the respective rotations, a second-color cyan toner image, a third-color yellow toner image, and a fourth-color black toner image are sequentially formed in that order on the photosensitive member 11 at the respective rotations by sequentially using developers 42 to 44 so that the four color images are superimposed on the intermediate transfer member 20 at the respective rotations, and hence a composite color toner image corresponding to an object color image is formed on the intermediate transfer member 20. In the apparatus shown in FIG. 3, at the respective rotations of the photosensitive member 11, the positions of the developers 41 to 44 are changed so that development of magenta toner M, cyan toner C, yellow toner Y, and black toner B are sequentially performed.

Next, a transfer roller 25 is then brought into contact with the intermediate transfer member 20 provided with the composite color toner image thereon, and to a nip portion therebetween, a recording medium 26 is supplied from a paper feed cassette 19. At the same time, a secondary transfer bias is applied to the transfer roller 25 from a power source 29, and the composite color toner image is transferred from the intermediate transfer member 20 onto the recording medium 26, followed by heating and fixing, thereby forming a final image. After the composite color toner image is transferred onto the recording medium 26, the intermediate transfer member 20 is processed by a cleaning device 35 so as to remove residual toners remaining on the surface and is then placed in a standby state for the following image formation.

In addition, a tandem type intermediate transfer method formed in combination between the tandem method and the intermediate transfer method has also been proposed. In FIG. 4, an image forming apparatus in accordance with a tandem type intermediate transfer method is shown by way of example in which color image formation is performed using an endless belt-shaped tandem type intermediate transfer member.

In the apparatus shown in the figure, a first development portion 54*a* to a fourth development portion 54*d* are sequentially disposed along a tandem type intermediate transfer member 50 for developing electrostatic latent images on photosensitive drums 52*a* to 52*d* using yellow, magenta, cyan, and black toners, respectively, and this tandem type intermediate transfer member 50 is circularly driven in the direction indicated by an arrow shown in the figure, so that four color toner images formed on the photosensitive drums 52*a* to 52*d* of the respective development portions 54*a* to 54*d* are sequentially transferred on this tandem type intermediate transfer member 50 to form a color toner image thereon. Subsequently, this toner image thus formed is transferred onto a recording medium 53 such as paper by transfer, thereby performing printout.

In the figure, reference numeral 55 indicates a drive roller or a tension roller circularly driving the tandem type intermediate transfer member 50, reference numeral 56 indicates a recording medium feed roller, reference numeral 57 indicates a recording medium feed device, and reference numeral 58 indicates a fixing device fixing an image on the recording medium by heating or the like. In addition, reference numeral 59 indicates a power source device (voltage application means) applying a voltage to the tandem type intermediate transfer member 50, and this power source device 59 is designed to be able to change the application direction of the voltage depending on the case in which the toner image is transferred onto the tandem type intermediate transfer member 50 from the photosensitive drums 52*a* to 52*d* and the case in which the toner image is transferred from the tandem type intermediate transfer member 50 to the recording medium 53.

In the various image forming apparatuses described above, as a conductive endless belt used as the transfer/transport belt 10, the intermediate transfer member 20, the tandem type intermediate transfer member 50, and the like, heretofore, a semiconductive resin film belt and a fiber reinforced rubber belt have been primarily used. Of the belts described above, as the semiconductive resin film belt, for example, a belt composed of a polycarbonate resin and carbon black compounded therewith, a belt primarily composed of a poly(alkylene terephthalate) resin, and a belt primarily composed of a thermoplastic polyamide resin have been proposed.

In addition, for example, in Japanese Unexamined Patent Application Publication No. 2001-125396, in order to improve the transfer efficiency and the image quality, a transfer belt has been disclosed having the structure composed of a tube member formed of a single layer or a laminate using a polymer material, a conductive layer provided on the outside surface of the tube member, and a semiconductive resin layer of a material having semiconductive properties provided on the above conductive layer. Furthermore, in Japanese Unexamined Patent Application Publication No. 2002-365866, in order to realize an electrophotographic seamless belt having uniform electrical resistance and superior surface and mechanical properties, a technique has been disclosed in which predetermined amounts of poly(ether ester amide) or poly(ether amide) and a fluorinated surfactant or a halogenated alkali metal are contained in a belt composed of a thermoplastic fluorinated resin.

As described above, as for the conductive endless belt, various researches have been conducted; however, concomitant with recent demanding requirements of performance, a belt having superior various properties has been increasingly desired. In particular, a conductive endless belt has been desired having small voltage dependence of resistance as electrical properties, superior durability in image output, and high toner transfer efficiency.

In addition, in the resin film belt described above, in order to obtain desired electrification properties required for the member, the adjustment of the conductivity has been generally performed by adding conductive materials such as an electron conductive agent or an ionic conductive agent; however, in electron-conduction belts using an electron conductive agent such as conductive carbon including carbon black filler, the voltage dependence of electrical resistance is large when a voltage is applied, and in particular, when a high voltage is applied, problems such as leakage may occur in some cases. Furthermore, when a low molecular weight-based antistatic agent is used, for example, various problems occur: the antistatic properties are degraded with time when electricity is supplied, and due to bleedout of a low molecular weight-based material, other constituent elements in contact therewith are contaminated.

SUMMARY OF THE INVENTION

Hence, an object of the present invention is to provide a conductive endless resin belt used in the tandem, intermediate transfer, and tandem type intermediate transfer image forming apparatuses and an image forming apparatus using the above conductive endless resin belt, the conductive endless resin belt having superior strength, in particular, superior folding endurance, stable and appropriate electrical resistance in high voltage application, less voltage dependence of electrical resistance, and superior durability in image output and transfer efficiency.

Through intensive research carried out by the inventors of the present invention in order to achieve the object described above, it was discovered that when a specific polymer material is used as a base material for the conductive endless belt, a high molecular weight ionic conductive agent is used as a conductive material, and a fluorinated surfactant is also used, the object described above can be achieved. As a result, the present invention was made.

That is, in accordance with one aspect of the present invention, there is provided a conductive endless belt used for a tandem type transfer and transport system in which the conductive endless belt is circularly driven by a drive member so as to transport a recording medium held by the belt using electrostatic adsorption to four types of image forming members, and in which respective toner images provided thereon are sequentially transferred onto the recording medium. The conductive endless belt described above comprises: a base material selected from the group consisting of (a) a thermoplastic polyamide resin, (b) an acrylonitrile-butadiene-styrene resin, (c) a thermoplastic polyacetal resin, (d) a polymer alloy or a polymer blend containing at least two of the resins (a) to (c), and (e) a polymer alloy or a polymer blend containing at least one of the resins (a) to (c) and a thermoplastic resin; a high molecular weight ionic conductive agent: and a fluorinated surfactant.

In accordance with another aspect of the present invention, there is provided a conductive endless belt used as an intermediate transfer member which is disposed between an image forming member and a recording medium, is circularly driven by a drive member, temporarily holds toner images which are transferred from the surface of the image forming member, and transfers the toner images onto the recording medium. The conductive endless belt described above comprises: a base material selected from the group consisting of (a) a thermoplastic polyamide resin, (b) an acrylonitrile-butadiene-styrene resin, (c) a thermoplastic polyacetal resin, (d) a polymer alloy or a polymer blend containing at least two of the resins (a) to (c), and (e) a polymer alloy or a polymer blend containing at least one of the resins (a) to (c) and a thermoplastic resin; a high molecular weight ionic conductive agent: and a fluorinated surfactant.

Furthermore, in accordance with still another aspect of the present invention, there is provided a conductive endless belt used as a tandem type intermediate transfer member which is disposed between four types of image forming members and a recording medium, is circularly driven by a drive member, temporarily holds toner images which are transferred from the surfaces of the four types of image forming members, and transfers the toner images onto the recording medium. The conductive endless belt described above comprises: a base material selected from the group consisting of (a) a thermoplastic polyamide resin, (b) an acrylonitrile-butadiene-styrene resin, (c) a thermoplastic polyacetal resin, (d) a polymer alloy or a polymer blend containing at least two of the resins (a) to (c), and (e) a polymer alloy or a polymer blend containing at least one of the resins (a) to (c) and a thermoplastic resin; a high molecular weight ionic conductive agent: and a fluorinated surfactant.

The belt of the present invention preferably further comprises a fluorinated resin as the base material. In addition, the fluorinated surfactant preferably contains a perfluoroalkenyl group, and as the thermoplastic resin, a thermoplastic elastomer is preferably used.

The high molecular weight ionic conductive agent preferably contains a poly(ether amide) component or a poly (ether ester amide) component, and in addition, the high molecular weight ionic conductive agent preferably contains an ionic conductive agent component having a low molecular weight. Furthermore, of the poly(ether amide) component or the poly(ether ester amide), the polyether component preferably contains a ($CH_2$—$CH_2$—O) group and the polyamide component preferably contains a nylon 12 or a nylon 6 resin, and in addition, the ionic conductive agent component having a low molecular weight preferably contains $NaClO_4$.

The addition amount of the fluorinated surfactant is preferably in the range of 0.01 to 20 parts by weight relative to 100 parts by weight of the base material, and the addition amount of the high molecular weight ionic conductive agent is preferably in the range of 1 to 500 parts by weight relative to 100 parts by weight of the base material. The conductive endless belt preferably has a volume resistivity of $10^7$ to $10^{14}$ Ω·cm. Furthermore, the conductive endless belt preferably has an engage portion engaging with the drive member at the side at which the conductive endless belt is to be in contact therewith, and the engage portion preferably has a protrusion shape continuously formed along the rotation direction.

In addition, in accordance with still another aspect of the present invention, there is provided an image forming apparatus comprising the conductive endless belt according to the present invention.

In the conductive endless belt of the present invention, since the specific polymer material described above is used as the base material, superior strength, in particular, superior folding endurance, can be obtained; since the high molecular weight ionic conductive agent is used, superior electrification properties can be obtained which may not cause any problems commonly observed in the past; and since the fluorinated surfactant is further used, the durability in image output and the transfer efficiency can both be improved. In addition, when the fluorinated resin is used in combination with the base material described above, a belt having superior toner-releasing properties can be formed. Furthermore, when the engage portion is provided so that the drive member and the conductive endless belt engage with each other, a phenomenon can be prevented in which a conductive endless belt wrapped around at least two shafts is gradually shifted in the width direction as the belt rotates. Hence, according to the image forming apparatus of the present invention using the conductive endless belt described above, even when the apparatus is used for a long period of time, no failure occurs at all, and in addition, superior image can be reliably provided.

DESCRIPTION OF THE PREFERRED EMBODIMENTS

Hereinafter, embodiments of the present invention will be described.

In general, two types of the conductive endless belts are present, one having a joint portion and the other having no joint portion (so-called seamless belt), and in the present invention, both of them may be used. However, preferable is a seamless belt. As described above, the conductive endless belt of the present invention is an endless belt which can be used as the transfer members of the tandem method, the intermediate transfer method, the tandem type intermediate transfer method and the like.

Figure 2:
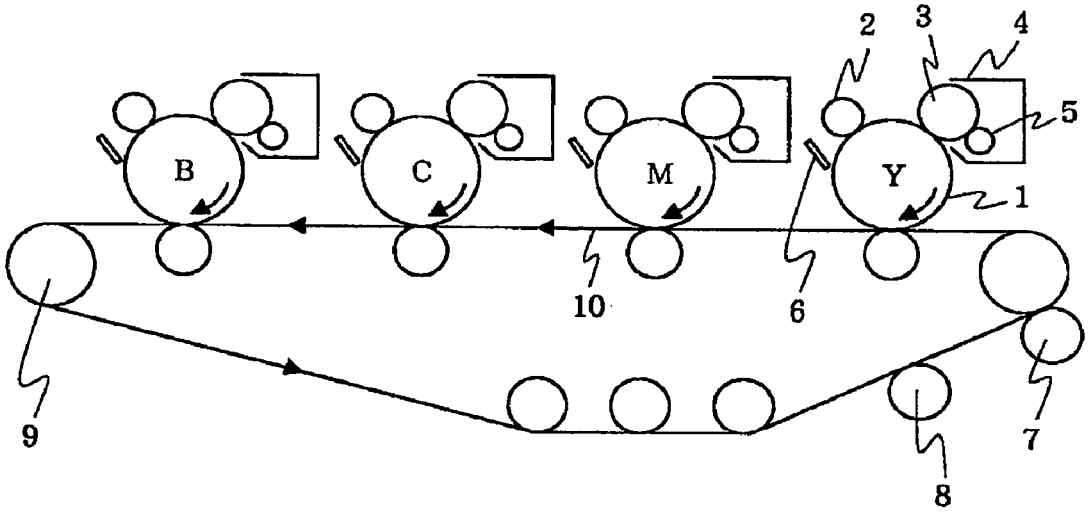
FIG. 2 is a schematic view showing a tandem image forming apparatus using a transfer/transport belt, as one example of an image forming apparatus of the present invention.

For example, in the case in which the conductive endless belt of the present invention is the transfer/transport belt shown in FIG. 2 indicated by reference numeral 10, the conductive endless belt is driven by a drive member such as the drive roller 9, and the toners are sequentially transferred onto the recording medium which is transported by the endless belt, thereby forming a color image.

Figure 3:
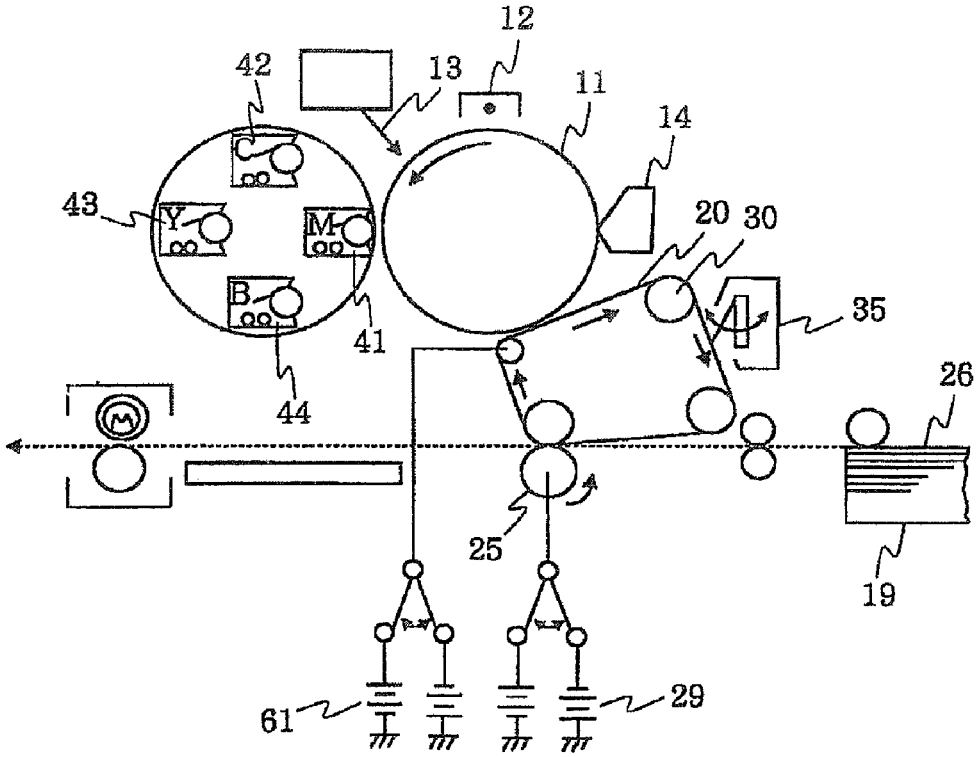
FIG. 3 is a schematic view showing an intermediate transfer apparatus using an intermediate transfer member, as another example of the image forming apparatus of the present invention.

In addition, for example, in the case in which the conductive endless belt of the present invention is the intermediate transfer member shown in FIG. 3 indicated by reference numeral 20, the conductive endless belt is circularly driven by a drive member such as the drive roller 30 and is disposed between the photosensitive drum (latent image holder) 11 and the recording medium 26 such as paper, and the toner image formed on the surface of the photosensitive drum 11 is transferred onto the conductive endless belt and is then temporarily held thereby, followed by transfer of the toner image onto the recording medium 26. As described above, the apparatus shown in FIG. 3 is an apparatus performing color printing in accordance with the intermediate transfer method.

Figure 4:
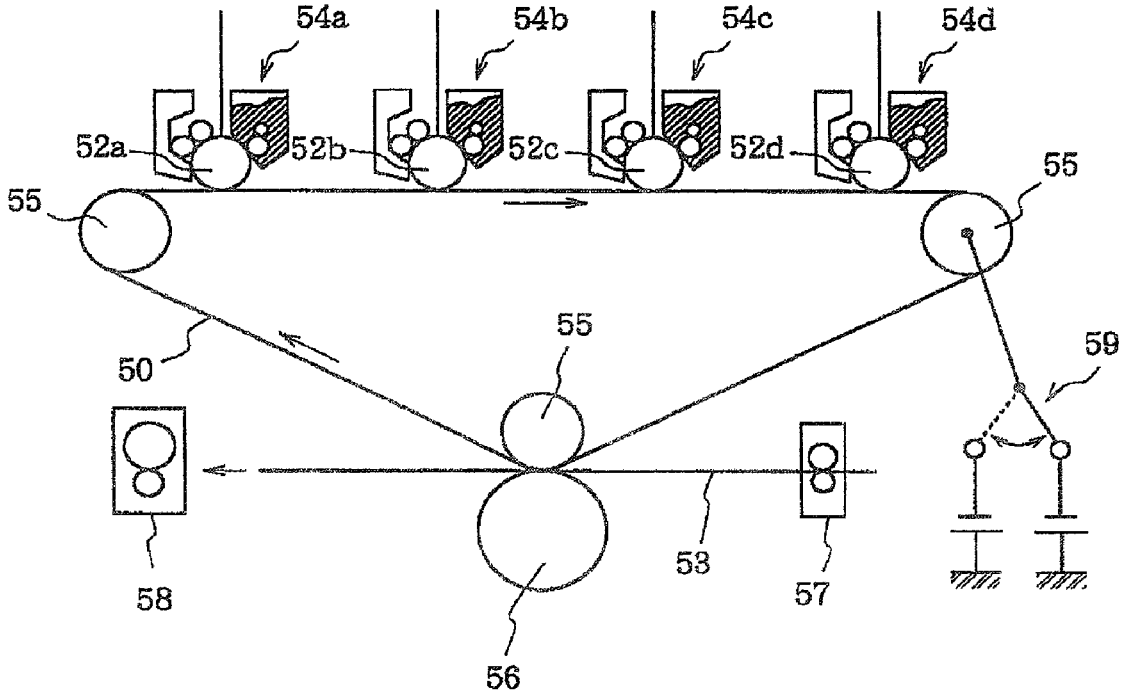
FIG. 4 is a schematic view showing a tandem type intermediate transfer apparatus using a tandem type intermediate transfer member, as still another example of the image forming apparatus of the present invention.

Furthermore, for example, in the case in which the conductive endless belt of the present invention is the tandem type intermediate transfer member shown in FIG. 4 indicated by reference numeral 50, the conductive endless belt is disposed between the development portions 54*a* to 54*d* having the photosensitive drums 52*a* to 52*d*, respectively, and the recording medium 53 such as paper and is circularly driven by a drive member such as the drive rollers 55, and the four color toner images formed on the surface of the photosensitive drums 52*a* to 52*d* are transferred onto the conductive endless belt and are then temporarily held thereby, followed by transfer of the toner images onto the recording medium 53, thereby forming a color image.

In the conductive endless belt of the present invention, a base material is used which is selected from the group consisting of (a) a thermoplastic polyamide resin (PA), (b) an acrylonitrile-butadiene-styrene resin (ABS), (c) a thermoplastic polyacetal resin (POM), (d) a polymer alloy or a polymer blend containing at least two of the resins (a) to (c), and (e) a polymer alloy or a polymer blend containing at least one of the resins (a) to (c) and a thermoplastic resin except for the resins (a) to (c), in particular, a thermoplastic elastomer. In the present invention, when one of the polymer materials (a) to (e) is used as the base material, a belt having superior strength, particularly superior folding endurance, can be obtained.

The thermoplastic polyamide (a) of the present invention is one of resins having the longest history and is used as a material having superior abrasion resistance besides superior strength and impact resistance, and in addition, the thermoplastic polyamide (PA) is easily commercially available. As PA, various types may be mentioned; however, in the present invention; nylon 12 (hereinafter referred to as "PA 12") such as Rilsan AESNOTL, which is the trade name, manufactured by Toray Industries, Inc., Diamide L2101 and Diamide L1940, each of which is the trade name, manufactured by Daicel Huels Ltd., or 3024U, which is the trade name, manufactured by Ube Industries Ltd., may be preferably used. PA 12 has superior dimensional stability capable of withstanding the change in circumstances as compared to that of the other PAs. In addition, PA 6 is also preferably used. When the thermoplastic polyamides described above are used as the base material for the conductive endless belt, a conductive endless belt can be obtained having small variation in electrical resistance and superior strength, in particular, superior folding endurance. As the PA 12 used in the present invention, the number average molecular weight is preferably 7,000 to 100,000 and more preferably 13,000 to 40,000.

As a preferable polymer alloy formed from the PA described above and a thermoplastic elastomer, a block copolymer alloy formed from PA 12 and a thermoplastic polyether may be mentioned by way of example. By this copolymer alloy, besides the dimensional stability, an effect of improving low-temperature properties can also be obtained. The polymer alloy of PA 12 and a thermoplastic polyester is also commercially available, and for example, Diamide X4442, which is the trade name, manufactured by Daicel Huels Ltd. may be mentioned.

In addition, as the thermoplastic elastomer suitably used for the polymer blend with PA, a polymer having a Young's modulus of 98,000 N/cm$^2$ or less and more preferably in the rage of 980 to 49,000 N/cm$^2$ has been known, and for example, a polyester, a polyamide, a polyether, a polyolefin, a polyurethane, a styrene, an acrylic, or a polydiene elastomer may be mentioned. When the thermoplastic elastomer is used for the polymer blend, the number of folding actions to failure can be increased, and the durability against cracking can also be improved. A polymer blend of PA 12 with a thermoplastic elastomer is also commercially available, and for example, Diamide E1947, which is the trade name, manufactured by Daicel Huels Ltd. may be mentioned.

As the ratio between PA and a thermoplastic elastomer for the polymer alloy and the polymer blend of the present invention, when PA is PA 12, with respect to 100 parts by weight of PA 12, 100 parts by weight or less of a thermoplastic elastomer is preferably use.

The acrylonitrile-butadiene-styrene (ABS) resin (b) of the present invention is a thermoplastic resin having superior impact resistance and dimensional stability and is easily commercially available. In particular, for example, Cevian V320 and Cevian V680, each of which is the trade name, manufactured by Daicel Polymer Ltd., may be mentioned. When the ABS resin described above is used as the base material, a conductive endless belt having small variation in electrical resistance, superior strength, in particular, superior folding endurance, and high dimensional stability can be obtained.

As preferable polymer alloys and polymer blends of the ABS resin described above, polymer alloys with a thermoplastic poly(butylene terephthalate) (PBT), a thermoplastic polycarbonate (PC), and thermoplastic polyamide (PA) may be mentioned by way of example. The above polymer alloys and polymer blends of the ABS resin with thermoplastic resins are commercially available, and for example, there may be mentioned polymer alloys manufactured by Daicel Polymer Ltd. under the trade names Novalloy B1500 and B1700 (PBT/ABS resin), Novalloy S1100 (PC/ABS resin), and Novalloy A1500 (PA 6/ABS resin). By those polymer alloys mentioned above, improvement in heat resistance, chemical resistance, and toughness (PBT/ABS resin), improvement in heat resistance, impact resistance, and toughness (PC/ABS resin), and improvement in impact resistance and chemical resistance (PA 6/ABS resin) can be achieved.

In addition, the thermoplastic polyacetal (POM) (c) of the present invention may be in the form of a homopolymer or a copolymer; however, a copolymer is preferable in terms of heat stability. Since having well balanced properties including strength, abrasion resistance, dimensional stability, moldability and the like, POM is categorized as an engineering plastic which is widely used for plastic gears and the like and is easily commercially available. For example, there may be mentioned Tenac 2010, which is the trade name, manufactured by Asahi Kasei Corporation, and Duracon M25-34, which is the trade name, manufactured by Polyplastic Co., Ltd. When the POM described above is used as the base material for the conductive endless belt, a conductive endless belt can be obtained having small variation in electrical resistance, superior strength, in particular, superior folding endurance and creep resistance, and high dimensional stability.

As a preferably polymer alloy containing the POMs described above, a polymer alloy with a thermoplastic polyurethane may be mentioned by way of example, and by this polymer alloy, besides the above superior properties, superior impact resistance can also be obtained. The polymer alloy of POM with a thermoplastic polyurethane is commercially available, and for example, Tenac 4012, which is the trade name, manufactured by Asahi Kasei Corporation, may be mentioned.

In addition, as a thermoplastic elastomer preferably used together with POM for forming a polymer blend, the same materials as mentioned for the case of the above PA may also be used. Also in this case, by the blending effect with the thermoplastic elastomer mentioned above, the number of folding actions to failure is increased, and durability against cracking can be improved.

In the present invention, as the base material, a fluorinated resin is preferably used together with the above polymer materials. When the fluorinated resin is blended and compounded with the above polymer materials, toner-releasing properties of the belt can be improved, and hence a high performance belt can be obtained. As the fluorinated resin described above, a resin having a low melting point such as 250° C. or less and particularly 240° C. or less is preferably used, and for example, there may be mentioned poly(vinylidene fluoride) (PVdF), polychlorotrifluoroethylene (PCTFE), copolymer of chlorotrifluoroethylene and ethylene (ECTFE), copolymer of vinylidene fluoride (VdF) and tetrafluoroethylene (TFE), and terpolymer (THV) of tetrafluoroethylene, hexafluoropropylene, and vinylidene fluoride. The fluorinated resins mentioned above are easily commercially available. As copolymers of vinylidene fluoride and tetrafluoroethylene, Neoflon VT100 and the like, which is the trade name, manufactured by Daikin Industries, Ltd., may be mentioned, and as THVs, THV 220G, THV 500G, and the like, which are the trade names, manufactured by Dyneon LLC (available through Sumitomo 3M Ltd.) may be mentioned.

The fluorinated resins mentioned above may be used alone or in combination; however, among those resins, THV, which has a significantly low melting point, such as approximately 120 to 200° C., is particularly preferable, and when compounded together with another material, THV is easily melted, and hence the blending effect can be obtained. THV is a resin material having a low melting point composed of three types of monomers, that is, tetrafluoroethylene, hexafluoropropylene, and vinylidene fluoride, and has superior machinability, solubility, cross-linking property, flexibility, adhesion property, transparency, and the like besides the properties of common fluorinated resins, such as heat resistance, chemical resistance, weather resistance, non-sticking property, and fire retardant properties. In THV, when the ratio among the above monomers is adjusted, the melting point may be changed.

The amount of the fluorinated resin relative to the total amount of the base material is preferably 0.1 to 50 percent by weight and more preferably approximately 1 to 20 percent by weight. When the amount of the fluorinated resin is too large, the volume resistivity of the belt is adversely affected; however, when the amount is in the range as described above, while the volume resistivity is not substantially changed, the toner-releasing properties and fusion resistance can be preferably obtained.

In the present invention, to the base material composed of the organic polymer component and/or the fluorinated resin, a high molecular weight ionic conductive agent is added as a conductive material. As the high molecular weight ionic conductive agent, for example, materials disclosed in Japanese Unexamined Patent Application Publication Nos. 9-227717, 10-120924, and 2000-327922 may be used; however, the conductive agent is not particularly limited.

In particular, a mixture composed of (A) an organic polymer material, (B) an ionic conducting polymer or copolymer, and (C) an inorganic or low molecular weight organic salt may be mentioned. As the component (A), for example, a polyacrylate, polymethacrylate, polyacrylonitrile, poly(vinyl alcohol), poly(vinyl acetate), polyamide, polyurethane, or polyester may be mentioned; as the component (B), for example, an oligoethoxylated acrylate or methacrylate, styrene oligoethoxylated at the aromatic ring, poly(ether urethane), poly(ether urea), poly(ether amide), poly(ether ester amide) or poly(ether ester) may be mentioned; and as the component (C), a salt of an inorganic or low molecular weight organic protonic acid containing an alkali metal, alkaline earth metal, zinc or ammonium may be used. For example, preferable salts are $LiClO_4$, $LiCF_3SO_3$, $NaClO_4$, $LiBF_4$, $NaBF_4$, $KBF_4$, $NaCF_3SO_3$, $KClO_4$, $KPF_6$, $KCF_3SO_3$, $KC_4F_9SO_3$, $Ca(ClO_4)_2$, $Ca(PF_6)_2$, $Mg(ClO_4)_2$, $Mg(CF_3SO_3)_2$, $Zn(ClO_4)_2$, $Zn(PF_6)_2$, and $Ca(CF_3SO_3)_2$.

Among those mentioned above, as the component (B), a high molecular weight ionic conductive agent containing a poly(ether amide) component or a poly(ether ester amide) component is preferable, and in addition to that, as the component (C), an ionic conductive agent component having a low molecular weight may also be contained. As the poly(ether amide) component and the poly(ether ester amide) component, ($CH_2$—$CH_2$—O) as the polyether component and nylon 12 or nylon 6 as the polyamide component are preferably contained, and a high molecular weight ionic conductive agent containing the above components as the compound (B) is preferably used. Of the high molecular weight ionic conductive agents described above, as a material containing $NaClO_4$, which is an ionic conductive agent component having a low molecular weight used as the component (C), for example, there may be mentioned Irgastat P18 and Irgastat P22, which are the registered trade names, manufactured by Ciba Specialty Chemicals Inc., and Pelestat NC6321, which is the trade name, manufactured by Sanyo Chemical Industries, Ltd. In addition, as a material which does not include $NaClO_4$, for example, Irgastat P16 and Irgastat P20, which are the registered trade names, manufactured by Ciba Specialty Chemicals Inc. may be mentioned.

The amount of the high molecular weight ionic conductive agent is preferably 1 to 500 parts by weight relative to 100 parts by weight of the base material and more preferably 10 to 400 parts by weight. As a result, the volume resistivity of an elastic material layer can be preferably adjusted in the range of $10^7$ to $10^{14}$ Ω·cm and more preferably in the range of $10^8$ to $10^{12.5}$ Ω·cm. In the present invention, since the above high molecular weight ionic conductive agent is used as the conducting material, the resistivity of the belt can be particularly decreased to a resistivity level of $10^{11}$ Ω·cm or less. When the amount of the high molecular weight ionic conductive agent is less than 1 part by weight, the resistivity level described above cannot be obtained. On the other hand, when the amount is more than 500 parts by weight, since properties such as the folding endurance may be adversely degraded in some cases, the amount is preferably set to 500 parts by weight or less.

To this conductive endless belt of the present invention, in order to improve the compatibility between the base material and the high molecular weight ionic conductive agent, a compatiblizer may be added. As compatiblizers preferably used in the present invention, for example, there may be mentioned EVA/EPDM/polyolefin graft copolymer, polyolefin graft copolymer and reactive (containing GMA, MAH) polyolefin graft copolymer, P(St-co-GMA), EGMA, P(Et-co-EA-co-MAH), olefin graft copolymer, maleinide polyolefin, SEBS and maleinide thereof, oxazoline group-containing styrene polymer or acrylonitrile-styrene polymer, maleinide EPDM, maleinide PE, maleinide PP, maleinide EVA, styrene-maleic anhydride copolymer, SAN graft EPDM, reactive polystyrene, polycaprolactone-b-polystyrene, reactive styrene-acrylonitrile copolymer, imidized polyacrylate, ethylene glycidyl methacrylate-acrylic acid copolymer, chlorinated polyethylene, reactive phenoxysilane compound, peroxide polymer, and polycaprolactone (in the abbreviations above, EVA represents ethylene-vinyl acetate copolymer, EPDM represents ethylene-propylene-diene copolymer, EGMA represents ethylene-glycidyl methacrylate copolymer, SEBS represents styrene-ethylene-butadiene-styrene copolymer, GMA represents glycidyl methacrylate, MAH represents maleic anhydride, and EA represents ethyl acrylate). When 0.1 to 20 parts by weight of the compatiblizer mentioned above is preferably added relative to 100 parts by weight of the total of the base material and the high molecular weight ionic conductive agent, the compatibility therebetween is improved, and the high molecular weight ionic conductive agent can be uniformly and preferably dispersed in the base material, so that a high performance conductive endless belt can be obtained.

In addition, in the present invention, to the base material containing the above polymer material and the fluorinated resin whenever it is desired, besides the high molecular weight ionic conductive agent, a fluorinated surfactant is also added. The fluorinated surfactant mentioned above is not particularly limited as long as containing a fluorine atom, and anionic, cationic, nonionic, and amphoteric types may all be used. In particular, a surfactant containing a perfluoroalkenyl group is preferably used. In addition, a fluorinated surfactant having a branched chain is more preferable since having low volatile properties and superior stability at a high temperature as compared to those of a surfactant having straight chain. As the preferable fluorinated surfactants described above, for example, FTERGENT 100, 110, and 300, which are the trade names, manufactured by NEOS Co., Ltd., are commercially available. Since the above three products are in the form of powder at room temperature, bleedout may rarely occur, and particularly, superior effects, such as stability at 200° C. or more, can be obtained.

When the fluorinated surfactant of the present invention is used together with the high molecular weight conductive agent described above, ions are dissolved in the polyether component of the ionic conductive polymer or copolymer used as the component (B), and hence the conductivity can be obtained. As a result, the volume resistivity of the belt is further decreased, and the transfer efficiency of toner can be improved. By the improvement in transfer efficiency of toner, cleaning properties for cleaning residual toner can also be improved. Hence, in the present invention, when the fluorinated surfactant is used, a material containing no ionic conductive agent component having a low molecular weight, that is, $NaClO_4$, may be used as the high molecular weight ionic conductive agent.

The amount of the fluorinated surfactant described above is preferably in the range of 0.01 to 20 parts by weight relative to 100 parts by weight of the base material and is more preferably in the range of 0.05 to 10 parts by weight. When the amount is less than 0.01 parts by weight, the durability in image output and the transfer efficiency are not sufficiently improved. On the other hand, when the amount is more than 20 parts by weight, the effects are saturated, and the cost is disadvantageously increased. Hence, the amount of the fluorinated surfactant is preferably set in the range described above. In particular, when a material containing the above ionic conductive agent component having a low molecular weight is contained in the high molecular weight ionic conductive agent, by addition of a smaller amount of the fluorinated surfactant, a sufficient effect can be obtained.

In addition, in the present invention, by adding another conductive material as a functional component to the base material, the conductivity may be imparted or adjusted in an auxiliary manner. As the conductive material described above, materials are not particularly limited, and for example, there may be mentioned cationic surfactant including quaternary ammonium salts such as perchlorates, chlorates, tetrafluoroborates, sulfates, ethosulfates, and halogenated benzyl salts (salts of benzyl bromide, benzyl chloride, and the like) of lauryl trimethylammonium, stearyl trimethylammonium, octadodecyl trimethylammonium, dodecyl trimethylammonium, hexadecyl trimethylammonium, or modified fatty acid-dimethylethylammonium; anionic surfactants including aliphatic sulfonates, higher alcohol sulfates, sulfates of higher alcohol-ethylene oxide adduct, and higher alcohol phosphates; amphoteric surfactants including various betaines; anti-static agents including non-ionic anti-static agents such as higher alcohol ethylene oxides, polyethyleneglycol fatty acid esters, and polyhydric alcohol fatty acid esters; metal salts of Group I such as $LiCF_2SO_2$, $NaClO_4$, $LiBF_4$, and NaCl; metal salts of Group II such as $Ca(ClO_4)_2$; and derivatives of the above conductive materials having at least one functional group (such as a hydroxyl group, a carboxyl group, or a primary or a secondary amine group) containing an active hydrogen reactive with isocyanate. Furthermore, for example, there may also be mentioned ionic conductive agents including complexes of the above conductive materials with polyhydric alcohols (such as 1,4-butanediol, ethylene glycol, polyethylene glycol, and propylene glycol)or its derivatives or complexes of the above conductive materials with ethyleneglycol monomethyl ether, ethyleneglycol monoethyl ether, and the like; conductive carbon materials such as ketchen black or acetylene black; rubber carbon materials such as SAF, ISAF, HAF, FEF, GPF, SRF, FT and MT; oxidation-treated carbon for color ink, pyrolytic carbon, natural graphite, artificial graphite and the like; metals and metal oxides such as tin oxide, titanium oxide, zinc oxide, nickel, and copper; and conductive polymers such as polyaniline, polypyrrole and polyacetylene.

The amount of the conductive materials described above is preferably in the range of 0.01 to 30 parts by weight relative to 100 parts by weight of the base material, and is more preferably in the range of approximately 0.1 to 20 parts by weight.

Furthermore, in the present invention, other functional components may also be added to the components described above as long as the effects of the present invention are not adversely affected. As the functional components mentioned above, for example, various fillers, coupling agents, anti-oxidants, lubricants, surface finishing agents, pigments, UV absorbers, anti-static agents, dispersants, neutralizing agents, foaming agents, and cross-linking agents may be optionally used. In addition, coloring may also be performed by adding a coloring agent.

The thickness of the conductive endless belt of the present invention is optionally determined in accordance with the structure of the transfer/transport belt or the intermediate transfer member; however, the thickness is preferably set in the range of 50 to 200 μm.

Figure 1:
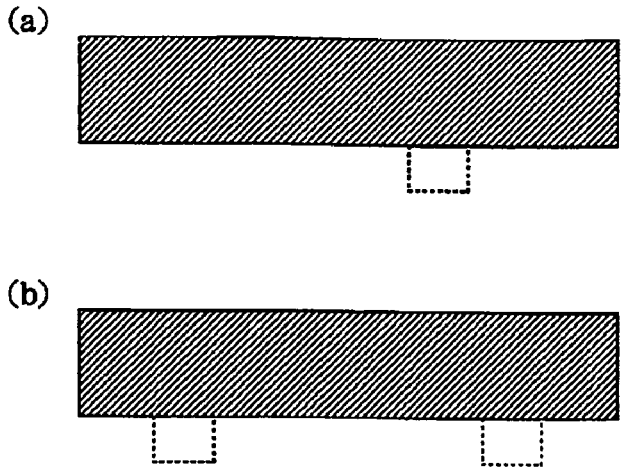
FIGS. 1A and 1B are cross-sectional views each showing a conductive endless belt in the width direction according to an embodiment of the present invention.

In addition, as shown by chain lines in FIGS. 1A and 1B, the conductive endless belt of the present invention may have an engage portion at the side to be brought into contact with the drive member such as the drive roller 9 of the image forming apparatus in FIG. 2 or the drive roller 30 in FIG. 3 so as to engage with an engage portion (not shown) provided for the drive member. When being driven while the engage portion of the belt engages with the engage portion of the drive member, the conductive endless belt of the present invention is prevented from being shifted in the width direction.

In this case, although not being particularly limited, as shown in FIGS. 1A and 1B, the engage portion preferably has a continuous protrusion shape along the circumferential direction (rotation direction) of the belt so as to engage with a groove formed in the drive member such as the drive roller along the circumferential direction.

In FIG. 1A, one continuous protrusion portion is shown as the engage portion by way of example; however, as the engage portion, many protrusion portions may be aligned along the circumferential direction (rotation direction) of the belt, at least two protrusion portions may be provided (shown in FIG. 1B), or one protrusion portion may be provided at the central portion in the width direction of the belt. Furthermore, instead of the protrusion portion used as the engage portion shown in FIGS. 1A and 1B, a groove may be provided in the belt along the circumferential direction (rotation direction) thereof so as to engage with a protrusion formed on the drive member such as the drive roller along the circumferential direction thereof.

Although not being particularly limited, the surface roughness of the conductive endless belt of the present invention, which is 10 point average roughness Rz specified by JIS, is preferably set to 10 μm or less, more preferably 6 μm or less, and even more preferably 3 μm or less.

In addition, as the image forming apparatus of the present invention using the conductive endless belt described above, the tandem apparatus shown in FIG. 2, the intermediate transfer apparatus shown in FIG. 3, and the tandem type intermediate transfer apparatus shown in FIG. 4 may be mentioned by way of example; however, the image forming apparatus of the present invention is not limited thereto. In the apparatus shown in FIG. 3, a voltage may be optionally applied from the power source 61 to the drive roller or drive gear which drives the intermediate transfer member 20 of the present invention, and in this case, the voltage application way may be optionally selected, for example, direct current is only applied or is superimposed on alternating current.

Furthermore, a method for manufacturing the conductive endless belt of the present invention is not particularly limited, and for example, the conductive endless belt may be manufactured by compounding the resin components of the base material and the functional components such as the conductive material by a biaxial kneader, followed by extrusion of the compound thus obtained using a ring-shaped dice. In addition, powder coating by electrostatic coating or the like, dipping, and centrifugal casting may also be preferably used.

EXAMPLES

Hereinafter, the present invention will be described in details with reference to examples.

Example 1

First, 60 parts by weight of a thermoplastic polyamide (PA 12) (trade name: 3024U, manufactured by Ube Industries Ltd.), 30 parts by weight of an acrylonitrile-butadiene-styrene resin (trade name: Cevian V680, manufactured by Daicel Polymer Ltd.), 35 parts by weight of a high molecular weight ionic conductive agent (trade name: Irgastat P18, manufactured by Ciba Specialty Chemicals Inc.), 10 parts by weight of a fluorinated resin (PVdF) (trade name: Neoflon VW410, manufactured by Daikin Industries, Ltd.), 0.4 parts by weight of a fluorinated surfactant (trade name: FTERGENT 100, manufactured by NEOS Co.), and 5 parts by weight of a coloring agent (trade name: ET500W, manufactured by Ishihara Techno Corp.) were mixed together, melted and then kneaded using a biaxial kneader at a predetermined temperature (see Table 2 below; in the following examples and comparative examples, also see Table 2). The compound thus obtained was extrusion molded by a single screw extruder provided with a ring-shaped dice at the front end thereof, so that a conductive endless belt having an internal diameter of 140 mm, a thickness of 100 μm, and a width of 247 mm was obtained.

Examples 2 and 3

Except that, instead of the fluorinated surfactant (trade name: FTERGENT 100, manufactured by NEOS Co.), a fluorinated surfactant (trade name: FTERGENT 110, manufactured by NEOS Co.) and a fluorinated surfactant (trade name: FTERGENT 300, manufactured by NEOS Co.) were used in Examples 2 and 3, respectively, the conductive endless belts were formed in the same manner as that in Example 1.

Examples 4 to 6

Except that, instead of the fluorinated resin (PVdF) (trade name: Neoflon VW410, manufactured by Daikin Industries, Ltd.), a fluorinated resin (trade name: Neoflon VP825, manufactured by Daikin Industries, Ltd.) was used, the conductive endless belts were formed in Examples 4 to 6 in the same manner as that in Examples 1 to 3, respectively.

Examples 7 to 9

Except that, instead of the fluorinated resin (PVdF) (trade name: Neoflon VW410, manufactured by Daikin Industries, Ltd.), a fluorinated resin (PVdF-PTFE) (trade name: Neoflon VT100, manufactured by Daikin Industries, Ltd.) was used, the conductive endless belts were formed in Examples 7 to 9 in the same manner as that in Examples 1 to 3, respectively.

Examples 10 to 12

Except that a high molecular weight ionic conductive agent (trade name: Irgastat P16, manufactured by Ciba Specialty Chemicals Inc.) was used instead of the high molecular weight ionic conductive agent (trade name: Irgastat P18, the amount of the fluorinated surfactant was increased to 2 parts by weight, and the coloring agent was not used, the conductive endless belts were formed in Examples 10 to 12 in the same manner as that in Examples 1 to 3, respectively.

Examples 13 and 14

Except that 80 parts by weight of a thermoplastic polyacetal (POM) resin (trade name: Duracon M25-44, manufactured by Polyplastic Co., Ltd.) was used as the base resin, the amount of the high molecular weight ionic conductive agent was decreased to 20 parts by weight, and the fluorinated resin and the coloring agent were not used, the conductive endless belts were formed in Examples 13 and 14 in the same manner as that in Examples 1 and 2, respectively.

Comparative Examples 1 to 3

Except that the fluorinated surfactant was not used, the conductive endless belts were formed in Comparative Examples 1 to 3 in the same manner as that in Examples 1, 4, and 7, respectively.

Comparative Example 4

Except that the fluorinated surfactant was not used, the conductive endless belt was formed in the same manner as that in Example 13.

For the conductive endless belts obtained in Examples 1 to 14 and Comparative Examples 1 to 4, the following measurements were performed as described below.

<Measurement of Dynamic Tensile Modulus (E')>

Under the following conditions, the measurement of the dynamic tensile modulus was performed.

Device: Rheolograph-Solid (trade name) manufactured by Toyo Seiki Seisaku-Sho, Ltd.

Shape of Sample: 5 mm wide, 0.15 to 0.22 mm thick, 30 mm in chuck distance

Measurement conditions: Initial Elongation: 3%
Amplitude: ±1%
Frequency: 1 Hz
Temperature: room temperature (22° C., 50%)

<Measurement of Volume Resistivity>

The volume resistivity was measured at a measurement voltage of 100 V, a temperature of 23° C., and a relative humidity of 50% using a sample chamber R12704A connected to a resistance meter R8340A manufactured by Advantest Corporation. Furthermore, the volume resistivity was measured under the same conditions by using the same device as described above except that the measurement voltage was set to 1,000 V, and according to the following equation, the number of digits of the voltage dependence was calculated.

$$(\text{Number of Digits})=\log(R_{100V}/R_{1,000V})$$

In the above equation, $R_{100V}$ and $R_{1,000V}$ indicate volume resistivity (Ω·cm) obtained at 100 V and that obtained at 1,000 V, respectively.

<Measurement of Number of Folding Actions to Failure>

The number of folding actions to failure was measured using a MIT type folding endurance tester manufactured by Toyo Seiki Seisaku-Sho, Ltd., and the results are shown by indices when the result of comparative example 1 is regarded as 100; hence, a higher index indicates a superior result.

<Image Quality>

The belts thus formed were mounted for the tandem image forming apparatus using the transfer/transport belt shown in FIG. 2, and an endurance test was performed in which transfer and transport were repeatedly performed for 100,000 sheets of A-4 sized paper. Based on the results of this endurance test, the image quality, stain resistance, toner deposition in the endurance test, and toner transfer efficiency were evaluated.

The compositions of the individual examples and comparative examples are shown in Table 1 below, and the molding temperatures and the results of the above measurements are shown in Table 2.

TABLE 1

| | Resin | | | High molecular weight ionic conductive agent | | Coloring agent | Fluorinated resin | | | Fluorinated surfactant | | |
|---|---|---|---|---|---|---|---|---|---|---|---|---|
| | | ABS | POM | | | | PVdF | | PVdF-PIFE | | | |
| | PA12 (3024U) | (Cevian V680) | (Duracon M25-44) | Irgastat P16 | Irgastat P18 | ET500W | Neoflon VW410 | Neoflon VP825 | Neoflon VT100 | Ftergent 100 | Ftergent 110 | Ftergent 300 |
| Example1 | 60 | 30 | — | — | 35 | 5 | 10 | — | — | 0.4 | — | — |
| Example2 | 60 | 30 | — | — | 35 | 5 | 10 | — | — | — | 0.4 | — |
| Example3 | 60 | 30 | — | — | 35 | 5 | 10 | — | — | — | — | 0.4 |
| Example4 | 60 | 30 | — | — | 35 | 5 | — | 10 | — | 0.4 | — | — |
| Example5 | 60 | 30 | — | — | 35 | 5 | — | 10 | — | — | 0.4 | — |
| Example6 | 60 | 30 | — | — | 35 | 5 | — | 10 | — | — | — | 0.4 |
| Example7 | 60 | 30 | — | — | 35 | 5 | — | — | 10 | 0.4 | — | — |
| Example8 | 60 | 30 | — | — | 35 | 5 | — | — | 10 | — | 0.4 | — |
| Example9 | 60 | 30 | — | — | 35 | 5 | — | — | 10 | — | — | 0.4 |
| Example10 | 60 | 30 | — | 35 | — | — | 10 | — | — | 2 | — | — |
| Example11 | 60 | 30 | — | 35 | — | — | 10 | — | — | — | 2 | — |
| Example12 | 60 | 30 | — | 35 | — | — | 10 | — | — | — | — | 2 |
| Example13 | — | — | 80 | — | 20 | — | — | — | — | 0.4 | — | — |
| Example14 | — | — | 80 | — | 20 | — | — | — | — | | 0.4 | — |
| Comparative Example1 | 60 | 30 | — | — | 35 | 5 | 10 | — | — | — | — | — |
| Comparative Example2 | 60 | 30 | — | — | 35 | 5 | — | 10 | — | — | — | — |
| Comparative Example3 | 60 | 30 | | — | 35 | 5 | — | — | 10 | — | — | — |
| Comparative Example4 | — | — | 80 | — | 20 | — | — | — | — | — | — | — |

TABLE 2

| | Molding temperature (° C.) | Dynamic tensile modulus (E') logE'(Pa) | Volume resistivity at 100 V logR(Ω · cm) | Voltage dependence 100-1000 V (number of digits) | Number of folding actions to failure (Index) | Image quality | Toner deposition in endurance test (10,000 sheets) | Stain resistance | Transfer efficiency |
|---|---|---|---|---|---|---|---|---|---|
| Example1 | 220 | 8.9 | 10.7 | 0.7 | 100 | Smooth and superior | Superior | Superior | 98≦ |
| Example2 | 220 | 8.9 | 10.3 | 0.7 | 100 | Smooth and superior | Superior | Superior | 98≦ |
| Example3 | 220 | 8.9 | 10.5 | 0.7 | 100 | Smooth and superior | Superior | Superior | 98≦ |
| Example4 | 220 | 8.9 | 10.0 | 0.6 | 100 | Smooth and superior | Superior | Superior | 98≦ |
| Example5 | 220 | 8.9 | 9.6 | 0.6 | 100 | Smooth and superior | Superior | Superior | 98≦ |
| Example6 | 220 | 8.9 | 9.8 | 0.6 | 100 | Smooth and superior | Superior | Superior | 98≦ |
| Example7 | 220 | 8.9 | 10.6 | 0.5 | 100 | Smooth and superior | Superior | Superior | 98≦ |
| Example8 | 220 | 8.9 | 10.2 | 0.5 | 100 | Smooth and superior | Superior | Superior | 98≦ |
| Example9 | 220 | 8.9 | 10.4 | 0.5 | 100 | Smooth and superior | Superior | Superior | 98≦ |
| Example10 | 220 | 8.8 | 10.7 | 0.7 | 100 | Smooth and superior | Superior | Superior | 98≦ |
| Example11 | 220 | 8.8 | 10.3 | 0.7 | 100 | Smooth and superior | Superior | Superior | 98≦ |
| Example12 | 220 | 8.8 | 10.5 | 0.7 | 100 | Smooth and superior | Superior | Superior | 98≦ |
| Example13 | 190 | 9.1 | 11.9 | 0.6 | 100 | Smooth and superior | Superior | Superior | 98≦ |
| Example14 | 190 | 9.1 | 11.8 | 0.7 | 100 | Smooth and superior | Superior | Superior | 98≦ |
| Comparative Example1 | 220 | 8.9 | 10.9 | 0.9 | 100 | Smooth and superior | Superior | Superior | 96 |

TABLE 2-continued

| | Molding temperature (° C.) | Dynamic tensile modulus (E') logE'(Pa) | Volume resistivity at 100 V logR(Ω · cm) | Voltage dependence 100-1000 V (number of digits) | Number of folding actions to failure (Index) | Image quality | Toner deposition in endurance test (10,000 sheets) | Stain resistance | Transfer efficiency |
|---|---|---|---|---|---|---|---|---|---|
| Comparative Example2 | 220 | 8.9 | 10.2 | 0.6 | 100 | Smooth and superior | Superior | Superior | 96 |
| Comparative Example3 | 220 | 8.9 | 10.8 | 0.6 | 100 | Smooth and superior | Superior | Superior | 96 |
| Comparative Example4 | 190 | 9.1 | 12.1 | 0.6 | 100 | Smooth and superior | Superior | Superior | 96 |

What is claimed is:

1. A conductive endless belt used for a tandem type transfer and transport system in which the conductive endless belt is circularly driven by a drive member so as to transport a recording medium held by the belt using electrostatic adsorption to four types of image forming members, and in which respective toner images provided thereon are sequentially transferred onto the recording medium, the conductive endless belt comprising:

a base material selected from the group consisting of (a) a thermoplastic polyamide resin, (b) an acrylonitrile-butadiene-styrene resin, (c) a thermoplastic polyacetal resin, (d) a polymer alloy or a polymer blend containing at least two of the resins (a) to (c), and (e) a polymer alloy or a polymer blend containing at least one of the resins (a) to (c) and a thermoplastic resin;

a high molecular weight ionic conductive agent; and a fluorinated surfactant, wherein an addition amount of the fluorinated surfactant is in the range of 0.01 to 20 parts by weight relative to 100 parts by weight of the base material.

2. The conductive endless belt according to claim 1, further comprising a fluorinated resin as the base material.

3. The conductive endless belt according to claim 1, wherein the fluorinated surfactant contains a perfluoroalkenyl group.

4. The conductive endless belt according to claim 1, wherein the thermoplastic resin comprises a thermoplastic elastomer.

5. The conductive endless belt according to claim 1, wherein the high molecular weight ionic conductive agent comprises a poly(ether amide), component or a poly(ether ester amide) component.

6. The conductive endless belt according to claim 5, wherein the high molecular weight ionic conductive agent comprises an ion conducting agent component having a low molecular weight.

7. The conductive endless belt according to claim 6, wherein, of the poly(ether amide) component or the poly (ether ester amide), a polyether component comprises a ($CH_2$—$CH_2$—O) group and a polyamide component comprises a nylon 12 resin or a nylon 6 resin, and the ion conducting agent component having a low molecular weight comprises $NaClO_4$.

8. The conductive endless belt according to claim 1, wherein the addition amount of the high molecular weight ionic conductive agent is in the range of 1 to 500 parts by weight relative to 100 parts by weight of the base material.

9. The conductive endless belt according to claim 1, wherein the conductive endless belt has a volume resistivity of $10^7$ to $10^{14}$ Ω·cm.

10. The conductive endless belt according to claim 1, wherein the conductive endless belt has an engage portion engaging with the drive member at the side at which the conductive endless belt is in contact therewith.

11. The conductive endless belt according to claim 10, wherein the engage portion has a protrusion shape continuously provided along the rotation direction of the belt.

12. An image forming apparatus, comprising the conductive endless belt according to claim 1.

13. A conductive endless belt used as an intermediate transfer member which is disposed between an image forming member and a recording medium, is circularly driven by a drive member, temporarily holds toner images which are transferred from the surface of the image forming member, and transfers the toner images onto the recording medium, the conductive endless belt comprising:

a base material selected from the group consisting of (a) a thermoplastic polyamide resin, (b) an acrylonitrile-butadiene-styrene resin, (c) a thermoplastic polyacetal resin, (d) a polymer alloy or a polymer blend containing at least two of the resins (a) to (c), and (e) a polymer alloy or a polymer blend containing at least one of the resins (a) to (c) and a thermoplastic resin;

a high molecular weight ionic conductive agent; and a fluorinated surfactant, wherein an addition amount of the fluorinated surfactant is in the range of 0.01 to 20 parts by weight relative to 100 parts by weight of the base material.

14. A conductive endless belt used as a tandem type intermediate transfer member which is disposed between four types of image forming members and a recording medium, is circularly driven by a drive member, temporarily holds toner images which are transferred from the surfaces of said four types of image forming members, and transfers the toner images onto the recording medium, the conductive endless belt comprising:

a base material selected from the group consisting of (a) a thermoplastic polyamide resin, (b) an acrylonitrite-butadiene-styrene resin, (c) a thermoplastic polyacetal resin, (d) a polymer alloy or a polymer blend containing at least two of the resins (a) to (c), and (e) a polymer alloy or a polymer blend containing at least one of the resins (a) to (c) and a thermoplastic resin;

a high molecular weight ionic conductive agent; and a fluorinated surfactant, wherein an addition amount of the fluorinated surfactant is in the range of 0.01 to 20 parts by weight relative to 100 parts by weight of the base material.

* * * * *